US012196516B2

(12) United States Patent
Russell

(10) Patent No.: US 12,196,516 B2
(45) Date of Patent: Jan. 14, 2025

(54) SEMI-AUTOMATIC RIFLE AND RETROFIT MAGAZINE

(71) Applicant: Osprey Armament, LLC, Oakdale, MN (US)

(72) Inventor: Mark Russell, Hutto, TX (US)

(73) Assignee: MK36 Holdings, LLC, Englewood, CO (US)

( * ) Notice: Subject to any disclaimer, the term of this patent is extended or adjusted under 35 U.S.C. 154(b) by 0 days.

(21) Appl. No.: 18/131,090

(22) Filed: Apr. 5, 2023

(65) Prior Publication Data

US 2023/0235980 A1 Jul. 27, 2023

Related U.S. Application Data

(63) Continuation of application No. 17/527,762, filed on Nov. 16, 2021, now abandoned, which is a continuation of application No. 16/547,405, filed on Aug. 21, 2019, now Pat. No. 11,204,210.

(60) Provisional application No. 62/720,846, filed on Aug. 21, 2018.

(51) Int. Cl.

| | |
|---|---|
| ***F41A 3/66*** | (2006.01) |
| *F41A 9/65* | (2006.01) |
| *F41A 17/36* | (2006.01) |
| *F41C 23/04* | (2006.01) |
| *F41C 23/16* | (2006.01) |

(52) U.S. Cl.

CPC ..... *F41A 3/66* (2013.01); *F41A 9/65* (2013.01); *F41A 17/36* (2013.01); *F41C 23/04* (2013.01); *F41C 23/16* (2013.01)

(58) Field of Classification Search

CPC .... F41A 3/66; F41A 9/65; F41A 17/36; F41A 9/70; F41A 17/38; F41A 5/18; F41C 23/04; F41C 23/16

USPC ..... 42/6, 16, 2, 5, 71.01, 74; 89/199, 198

See application file for complete search history.

(56) References Cited

U.S. PATENT DOCUMENTS

| | | | | |
|---|---|---|---|---|
| 2,951,424 | A | 9/1960 | Stoner | |
| 3,198,076 | A | 8/1965 | Stoner | |
| 3,318,192 | A | 5/1967 | Miller et al. | |
| 3,618,457 | A | 11/1971 | Miller | |
| 3,771,415 | A | 11/1973 | Into et al. | |
| 3,776,095 | A | 12/1973 | Atchisson | |
| 4,008,537 | A | 2/1977 | Elbe | |
| 4,058,922 | A | 11/1977 | Elbe et al. | |
| 4,142,314 | A | 3/1979 | Foote | |
| 4,416,186 | A | 11/1983 | Sullivan | |
| 4,910,904 | A | 3/1990 | Rose | |
| 4,938,116 | A | 7/1990 | Royster | |
| 5,272,856 | A | 12/1993 | Pharo | |
| 5,272,956 | A * | 12/1993 | Hudson | F41A 5/28 89/193 |
| 6,418,833 | B1 | 7/2002 | Hajjar | |
| 6,732,466 | B2 | 5/2004 | Bentley | |

(Continued)

*Primary Examiner* — Michael D David

(74) *Attorney, Agent, or Firm* — Polsinelli PC

(57) ABSTRACT

A lower receiver assembly of a rifle including a lower receiver having a magazine well formed thereon between a distal end and a proximal end, the lower receiver operable to receive a trigger assembly including a trigger, a hammer, and a firing pin. The lower receiver can include an operating rod retention tab coupled with an upper surface of the receiver and the operating rod retention tab extends above the upper surface and is operable to be received in a groove formed in a receiver of an upper receiver.

17 Claims, 12 Drawing Sheets

(56) References Cited

U.S. PATENT DOCUMENTS

| | | | | |
|---|---|---|---|---|
| 6,848,351 | B1 | 2/2005 | Davies | |
| 6,931,978 | B1 | 8/2005 | Dionne | |
| 7,261,029 | B1 | 8/2007 | Davis | |
| 7,340,857 | B1 | 3/2008 | Bentley | |
| 7,770,318 | B2 | 8/2010 | Bentley | |
| 8,661,963 | B2 * | 3/2014 | Patel | F41A 3/82 42/16 |
| D708,288 | S | 7/2014 | Bero | |
| D710,964 | S | 8/2014 | Chvala | |
| D713,483 | S | 9/2014 | Firpo, I et al. | |
| 9,194,638 | B2 | 11/2015 | Larson, Jr. et al. | |
| 9,310,148 | B2 | 4/2016 | Brown | |
| 9,410,757 | B2 | 8/2016 | Miller, III | |
| 9,482,479 | B1 | 11/2016 | Jen | |
| 9,909,835 | B1 | 3/2018 | Smith | |
| 10,215,513 | B2 | 2/2019 | Cross | |
| 10,443,964 | B2 | 10/2019 | Brown | |
| 10,495,399 | B1 | 12/2019 | Dalessio et al. | |
| 2005/0262752 | A1 | 12/2005 | Robinson et al. | |
| 2007/0214697 | A1 | 9/2007 | Ochoa | |
| 2012/0204713 | A1 | 8/2012 | Patel | |
| 2014/0041275 | A1 | 2/2014 | Herrington | |
| 2018/0080730 | A1 | 3/2018 | Cook et al. | |
| 2019/0093978 | A1 | 3/2019 | Maugham | |
| 2020/0064090 | A1 * | 2/2020 | Russell | F41A 9/70 |
| 2020/0386501 | A1 | 12/2020 | Dagher et al. | |

* cited by examiner

SEMI-AUTOMATIC RIFLE AND RETROFIT MAGAZINE

CROSS-REFERENCE TO RELATED APPLICATIONS

This application is a continuation of U.S. Non-Provisional application Ser. No. 17/527,762 filed Nov. 16, 2021, which is a continuation of U.S. Non-Provisional application Ser. No. 16/547,405 filed Aug. 21, 2019, which claims the benefit of and priority to U.S. Provisional Application No. 62/720,846, filed Aug. 21, 2018, the contents of each of which are incorporated by reference herein in their entirety.

FIELD

The present disclosure relates generally to firearms, more particularly to semi-automatic types of rifles.

BACKGROUND

The U.S. "M1" rifle, also known as the M1 Garand rifle, was the main battle rifle of the U.S. military from 1936 to 1957. While considered to be technologically advanced in its time. The gas operating system employed on the M1 utilizes an operating rod that is nearly as long as the barrel and a gas cylinder that is mounted very close to the barrel. In order for the rifle to function properly the operating rod must be shaped in a manner to clear the stock.

The M1 rifle is designed to feed ammunition from eight-round en bloc clips. With this design, both the round and the clip are inserted as a unit into a fixed magazine within the rifle, and the clip is usually ejected or falls from the rifle upon firing or chambering of the last round. The M1 is configured such that rounds are fed from the top of the rifle, through an open receiver top, requiring that any added optics or other accessories be mounted on the side of the receiver.

The M1 rifle also uses an indirect bolt stop mechanism that acts on the operating rod, not the bolt itself. The design of the stock on the M1 rifle employs two hand guards to cover the barrel and the operating rod, and which extends nearly to the muzzle of the rifle.

The M1 and the M14 are very rugged rifle designs, with several very desirable qualities, including accuracy, dependability, simplicity and ease of use. All of the earlier designs were based on using the well-proven trigger mechanism of the M1 in some form. This feature, by its nature, limited stock designs and weapon size. These earlier designs all required complex and time-consuming machining operations related to this mechanism and its placement in the receiver. The firing pin safety bridge in these designs was an integral part of the receiver, and required extensive and complicated milling or casting techniques to be used to make this part. The earlier designs also utilized a hand guard system that either attached to the barrel or stock. The earlier designs further required either side mounted scopes or machined in rails to mount optics. The nature of the M1 design required that the barrel be held down by a barrel band or a larger magazine well. On M1 and descendant designs, the forward portion of the operating rod was partially covered by the stock and hand guards but at least partially exposing the rod.

BRIEF DESCRIPTION OF THE DRAWINGS

Further features of the present disclosure will become apparent to those skilled in the art to which the present disclosure relates from reading the following specification with reference to the accompanying drawings, in which.

DETAILED DESCRIPTION

Figure 1:
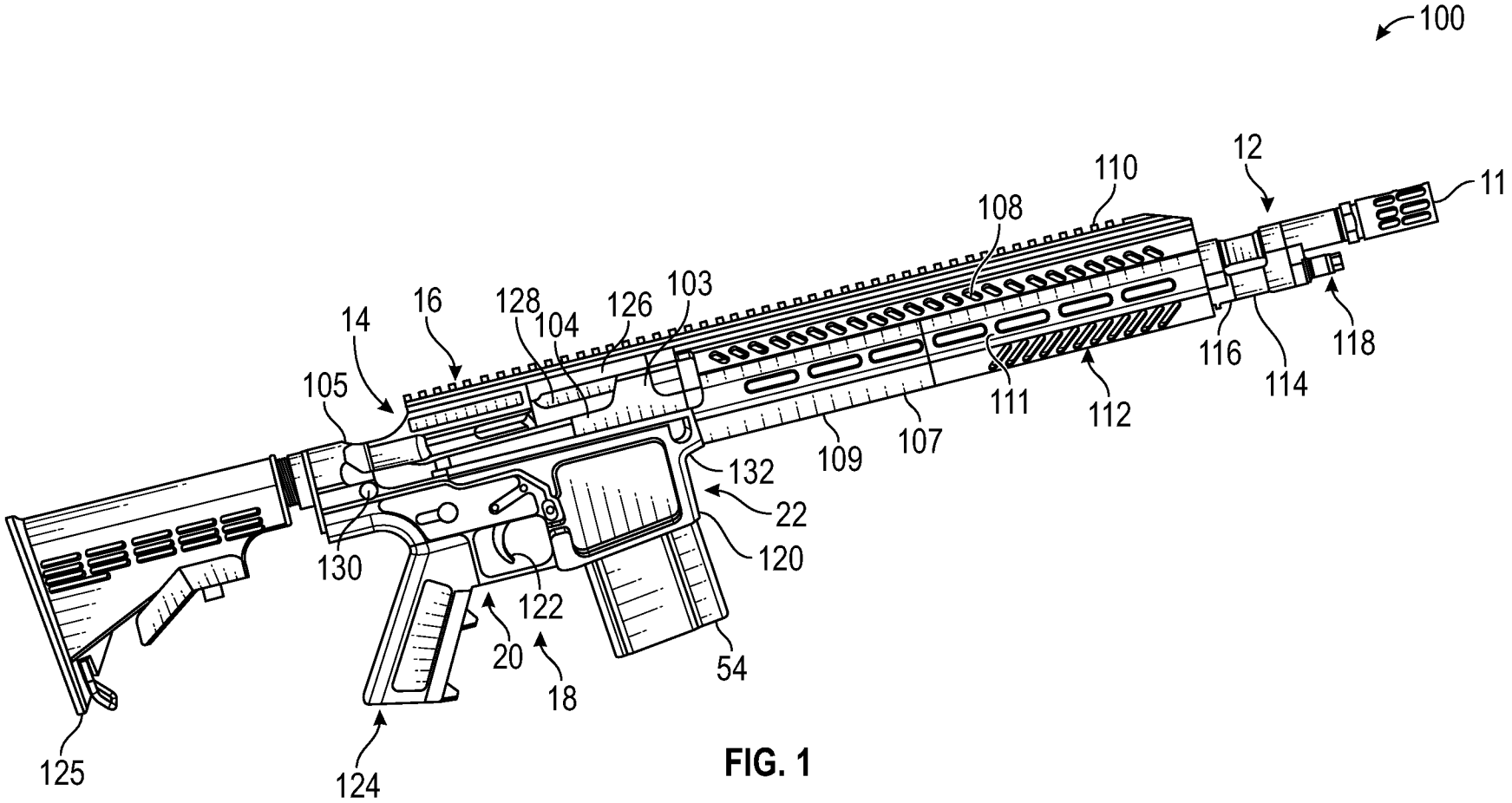
FIG. 1 is a perspective view of a semi-automatic rifle according to an embodiment of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" means "including, but not necessarily limited to"; it specifically indicates open-ended inclusion or membership in a so-described combination, group, series and the like.

The term "AR-style" and/or "AR platform" refers to a lower receiver stylized and/or designed to implement parts compatible with an AR-15 and/or AR-10 originally designed by ArmaLite and subsequently by Colt Manufacturing Company. The AR lower receiver can include a firing control system, butt stock, grip, and/or trigger assembly.

The presently disclosed rifle is a significant improvement over the previously discussed rifle designs. The rifle of the present disclosure uses an advanced upper and lower receiver design to facilitate ease of manufacture, assembly, cleaning, and/or parts replacement with an M14-style barrel group and allowing interchangeability and customization using AR-style lower receiver accessories and/or parts. While generally described with respect to a "semi-automatic rifle," the rifle can equally be implemented as an automatic rifle (e.g. "fully" automatic) without deviating from the present disclosure.

The present disclosure includes a rifle, of the gas operated, piston driven, air cooled, box-style magazine-fed type. The rifle can use an M1/M14 style barrel, bolt, and upper receiver coupled with an AR style lower. Thus, providing users the reliability of the M1/M14 platform and the customization and ergonomics available with the AR platform.

The rifle of the present disclosure can be configured and adapted to accept, operate with and discharge rifle cartridges of various calibers and loads. For example, the rifle of the present disclosure can be configured and adapted to utilize cartridges from those similar in size to the 5.56×45 mm to those similar in size to the 300 Winchester magnum or even .338 Lapua Magnum. Accordingly, the rifle can be configured and adapted to be compatible with appropriately modified existing box-style magazines and/or proprietary designed magazines that are also compatible with cartridges of these same various calibers, as explained below with respect to FIGS. 10-12. Moreover, the rifle 100 of the present disclosure can be adapted to provide for select-fire capability.

Further, the rifle can be adapted and configured to operate as a precision rifle, a Squad Auto-Weapon (SAW), a Personal Defense Weapon (PDW) in an addition to a standard battle rifle. When fully assembled the semi-automatic rifle of the present disclosure, without accessories, can weigh less than approximately 4 kilograms (kg), have a barrel approximately 25-61 centimeters (cm) long but with a 40 cm barrel the overall length of the rifle is approximately 90 cm. In some instances, a collapsible and/or foldable stock can be coupled with the rifle and set to the folded or collapsed position, thus operably reducing the overall length of the rifle can be approximately 90 cm in length.

The present technology can reduce machine time and core count of casting dies for manufacture of the rifle. The upper receiver according to the present disclosure utilizes a screwed-on sight (or other accessory) rail to make the interior of the receiver easier to access during manufacture, while having recoil lugs built into the upper receiver to solidly position the mount. The upper receiver can attach to a lower receiver assembly using two pins, a pivot pin and a takedown pin. The butt stock (and/or other collapsible stock) and grip can be attached to the lower receiver assembly. The grip and butt stock can be standard, commercial off-the-shelf (COTS) parts (for example, MilSpec and/or United States Defense Standards) and can be interchangeably, upgradable, or replaceable independent of the rifle platform.

The lower receiver assembly allows for a specialized stock to be raised to a position in line with the bore of the barrel to reduce recoil and muzzle rise. The reduced recoil and muzzle rise greatly enhance the ability of the shooter to fire an on-target follow up shot more rapidly.

The hand guard of the rifle can attach to the upper receiver to enhance accuracy and to reduce complexity of manufacture. The hand guard can also cover the forward section of the operating rod to enhance safety and reliability. The hand guard can couple with the upper receiver to form a co-planar rail extending along at least a portion of the upper receiver continuously through at least a portion of the hand guard. The hand guard can further include a pivoting door (and/or other access point) therein, accessible when the upper receiver is decoupled from the lower receiver allowing removal of the operating rod spring guide and operating rod for cleaning without disturbing the co-planar rail, therefore maintaining alignment of any optics coupled with the sight/accessory rail. The hand guard can also include at least one accessory rail configured to receive monopods, bipods, optics, lights, and the like.

In some instances of the present disclosure, the AR style lower and/or the AR style upper can be modified preventing a standard COTS AR lower and/or AR upper from mounting with the AR style lower and/or AR style upper as disclosed herein.

While the present disclosure is described with respect to a pivoting access point, it is within the scope of this disclosure to include an access point transitionable between an open position and closed position including, but not limited to, sliding access point, pivoting access point, pressure fit access point, rotating access point. Further, while the present disclosure is described with respect to a singular access point, it is within the scope of this disclosure to implement any number of access points within the hand guard to provide sufficient access for removal and/or cleaning of interior elements.

The barrel group can include an integral gas cylinder that in at least one instance is coupled to the barrel by a barrel shoulder. When a coupling of the gas cylinder is implemented, the construction of the rifle benefits from proper alignment of the barrel and gas cylinder, a faster assembly, and ease of manufacture by eliminating alignment shims to the barrel and gas system. The present barrel and cylinder design can allow for standard muzzle device attachments, such as flash suppressors, silencers and the like. The present rifle is designed to be compatible with a variety of cartridge sizes by swapping barrels, bolts and magazines to accommodate standard currently available magazines. In other instances, the barrel can feature an integral gas cylinder that is permanently attached to the barrel by welding and/or bonding.

FIG. 1 illustrates the general arrangement of a rifle 100, according to at least one instance of the present disclosure. The rifle 100 can include of a plurality of parts grouped together along with each group's respective components. In at least one instance, the plurality of parts can be groups that work and/or function together to facilitate the operation of the rifle 100 as a whole.

In at least one instance, the rifle 100 can include a barrel group 12, an upper receiver group 14, a bolt group 16, a lower receiver 18 group, a trigger group 20, and a magazine group 22. The components of each of these groups will be described in detail herein. In at least one instance, the upper receiver group 14 can include the bolt group 16 received therein and the lower receiver group 18 can include the trigger group 20 and magazine group 22 coupled thereto.

While the present disclosure relates to a rifle 100 having a barrel group 12, upper receiver group 14, bolt group 16, lower receiver 18 group, trigger group 20, and a magazine group 22, a rifle having more or less of the above groups can be implemented without deviating from the present disclosure. Additionally, each group can contain fewer and/or additional components to those described below with respect to each group.

The rifle 100 can provide a number of features to enhance reliability, ease of cleaning, and/or customization with respect to presently available rifles. The barrel group 12 can include a barrel 10 substantially similar to that of an M1 and/or M14 rifle, while the lower receiver 18 can include an AR-style lower. The AR-style lower receiver 18 can allow users to implement any number of customizations and/or third-party products available to standard AR customers for use with AR-15 and/or AR-10 platforms. The lower receiver 18 implemented within the rifle 100 of the present disclosure can include a number of modifications and/or customizations to allow operation with the barrel group 12 while still maintaining interoperability with any number of customizations and/or third-party products available for use with the AR-15 and/or AR-10 platform.

Figure 2:
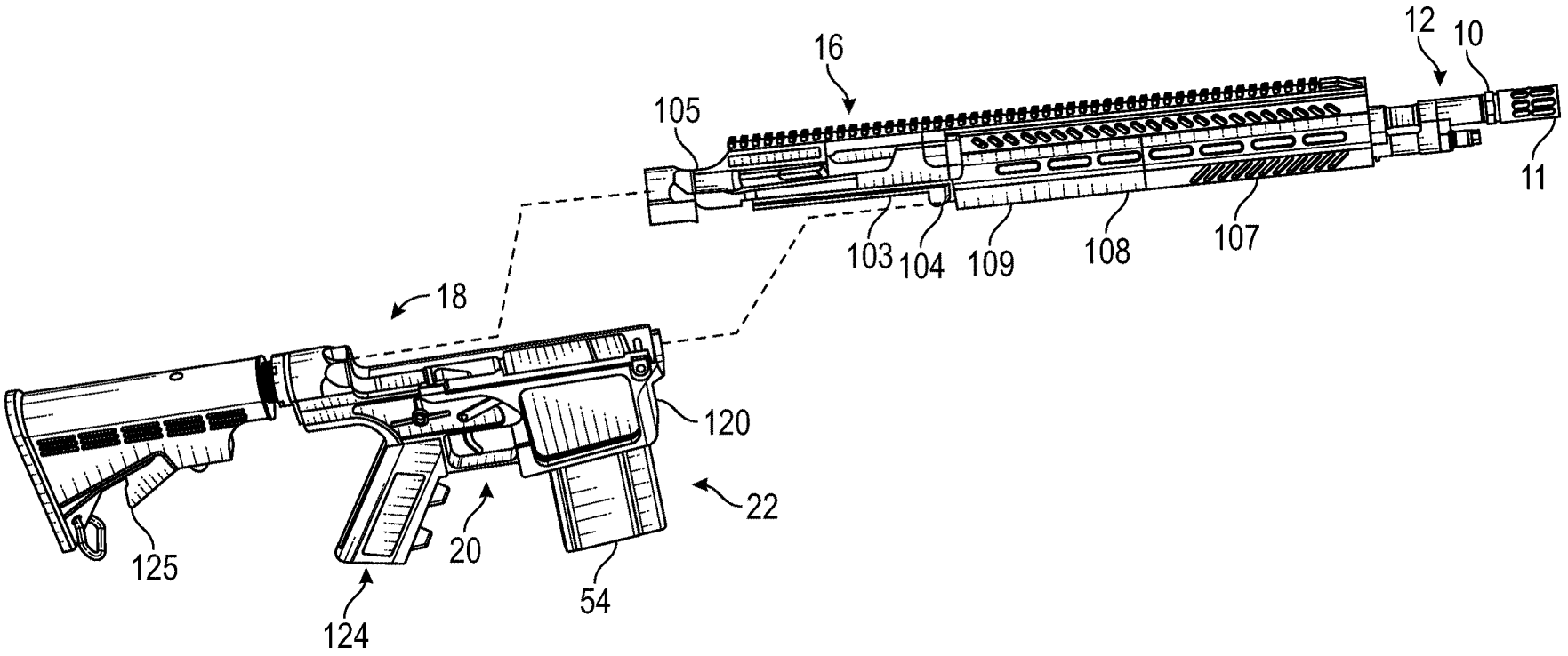
FIG. 2 is a partially exploded view of the semi-automatic rifle of FIG. 1.

FIG. 2 illustrates a partially exploded view of the rifle. The rifle 100 is shown having the barrel group 12 and upper receiver group 14 (including the bolt group 16) decoupled from the lower receiver 18 including the trigger group 20 and magazine group 22.

The upper receiver group 14 can include an upper receiver 105 operably couplable with the lower receiver 18 by two or more pins. In at least one instance, as illustrated in FIG. 2, the upper receiver 105 and the lower receiver 18 can be coupled together by two pins, a takedown pin 130 and a pivot pin 132. The takedown pin 130 and pivot pin 132 can be press-fit pins operable to be removed for disassembly, cleaning, and/or maintenance of the rifle 100.

The upper receiver group 14 can include a hand guard assembly 107 disposed over at least a portion of the barrel group 12. In at least one instance, the hand guard assembly 107 can substantially cover the exposed portions of the gas-cylinder system 114. The hand guard assembly 107 can provide a user protection from moving elements during operation of the rifle 100, while simultaneously providing accessory mounting points. The hand guard assembly 107 can be coupled with the upper receiver group 14. In at least one instance, the hand guard assembly 107 can be configured to attach only to the upper receiver group 14. In other instances, the hand guard assembly 107 can be coupled to the receiver 105.

The hand guard assembly 107 can have at least one accessory rail 110 formed thereon to receive monopods, bipods, lights, optics, laser designators, fore grips, and other similar accessories known in the art. In at least one embodiment, the accessory rail 110 can be a picatinny rail. As can be appreciated in FIG. 1 and FIG. 2, the hand guard assembly 107 includes four accessory rails 110, 111, 112 disposed on each side of the hand guard 107 assembly. While the fourth accessory rail is not specifically visible in FIG. 1, the fourth accessory rail can be disposed on the sidewall opposite accessory rail 111.

In at least one instance, the handguard assembly 107 and the receiver 105 can form a substantially continuous accessory rail 110 coupled along at least a portion of the top surface of the handguard assembly 107 and the receiver 105, respectively. The substantially continuous accessory rail 110 can allow for the mounting of one or more optical sights along the longitudinal length 195 of the rifle 100 and in line with the barrel 10. The rifle 100 can allow for field breakdown and/or cleaning of all critical elements without decoupling the hand guard assembly 107 from the receiver 105, therefore allowing the substantially continuous accessory rail 110 to maintain coplanar alignment.

In at least one embodiment, the at least one accessory rail 110 is coupled to the barrel group 12. These accessory rails 110, 111, 112 can be at positions corresponding to at least one of the 12 o'clock, 3 o'clock, 6 o'clock or 9 o'clock positions about the barrel group 12. In other embodiments, the accessory rails 110, 111, 112 can be position approximately 90 degrees apart one from the other. In some instances, the semi-automatic rifle 100 has a top rail 110 and a bottom rail 112 disposed approximately 180 degrees apart and two side accessory rails 111 disposed approximately 180 degrees apart, such that no two accessory rails 110, 111, 112 are more than approximately 90 degrees apart. One or more of the accessory rails 110, 111, 112 can be coupled to the hand guard 107, the barrel 10, the receiver 105 or a combination thereof. The accessory rails 110, 111, 112 can be manufactured by a milling process.

Figure 9A:
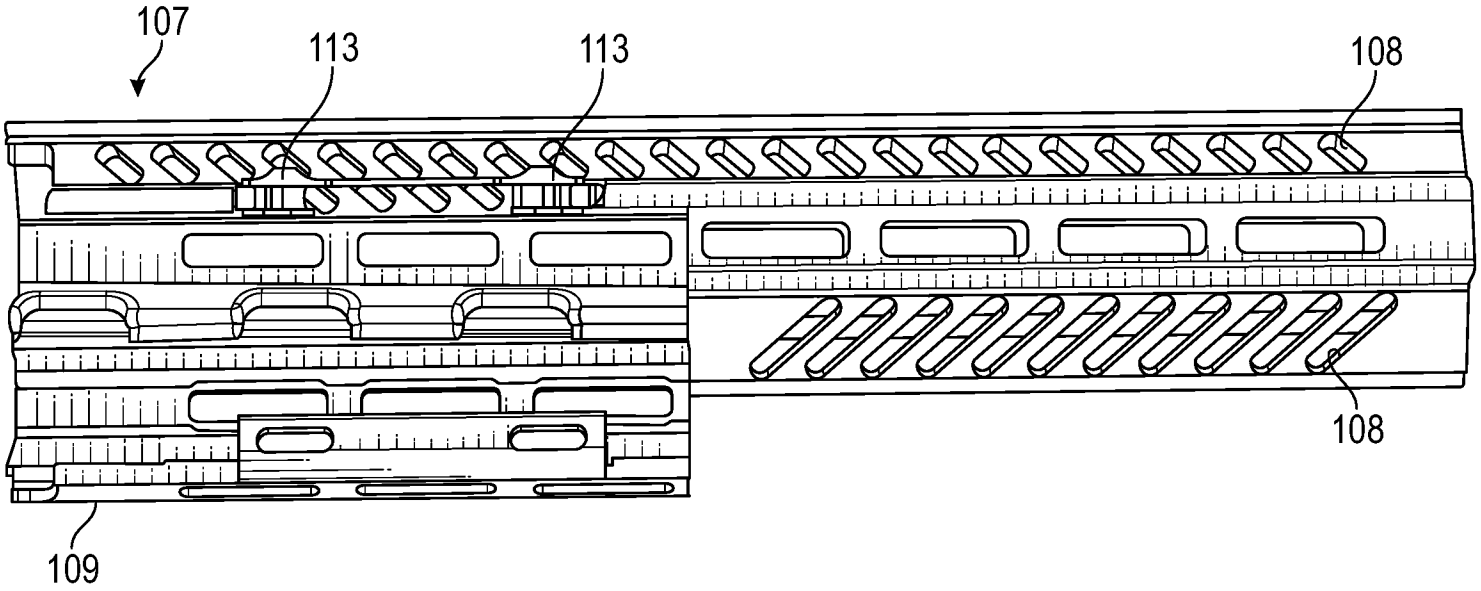
FIG. 9A is a plane view of a hand guard assembly having an access point in the open position.
Figure 9B:
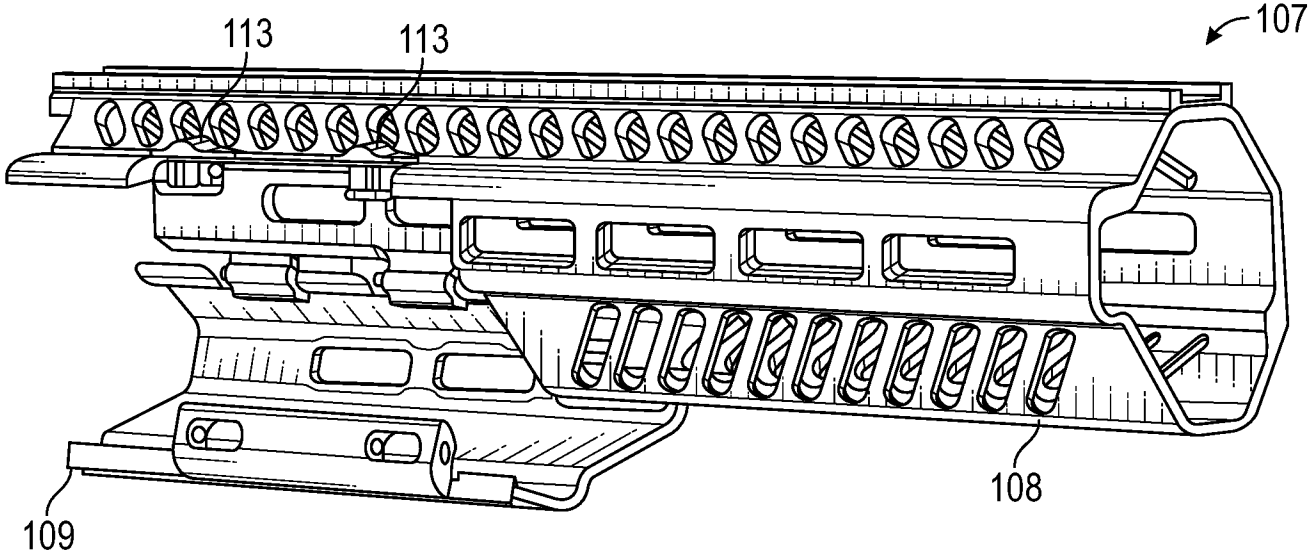
FIG. 9B is a isometric view of a hand guard assembly having an access point in the open position.

As discussed in more detail with respect to FIGS. 9A and 9B, the hand guard assembly 107 can include one or more access points 109 to facilitate removal, cleaning, installation, and/or replacement of an operating rod 103 and/or an operating rod biasing element 183. The one or more access points 109 can be operably available when the rifle 100 is disassembled as shown in FIG. 2 in which the upper receiver group 14 is decoupled from the lower receiver group 18. While FIGS. 9A and 9B shows a longitudinally pivoting "trap" door, it is within the scope of the present disclosure to implement and/or include any transitionable access point within the hand guard assembly 107 including, but not limited to, lateral pivoting, longitudinal sliding, lateral sliding, tongue and groove coupling, snap connections, and/or pressure coupling.

Referring to FIGS. 1 and 2, the lower receiver 18 can include a trigger group 20, a magazine group 22, a grip 124, and a butt stock 125. The trigger group 20 can be configured to interact with the firing pin (not shown) and bolt 128 to fire a round from a cartridge recessed in the chamber. The trigger group 20 can include a trigger 122 configured to actuate a hammer 176. When the rifle 100 is in battery, actuation of the trigger 122 can actuate the hammer 176, thereby discharging the rifle. Interaction between the bolt 128 and the operating rod 103 with charging handle 104 built in, a gas piston 182 at the end of the operating rod 103, the operating rod biasing element 183 and operating rod biasing element guide 184 (shown more clearly in FIG. 3) allow for semi-automatic and/or automatic operation of the rifle 100.

The lower receiver 18 can be a metal and/or composite housing that holds a trigger group 20 including a trigger mechanism 122 and operably receives a magazine 54 within a magazine well 120 in the appropriate position to interact with the bolt 128. The magazine 54 must be received and positioned within the magazine well 120 to ensure the passage of the bolt 128 draws a single round and aligns properly to prevent jamming. The lower receiver group 18 can also be the attachment point for a safety selector switch, magazine release, grip 124 and/or a butt stock 125.

Figure 3:
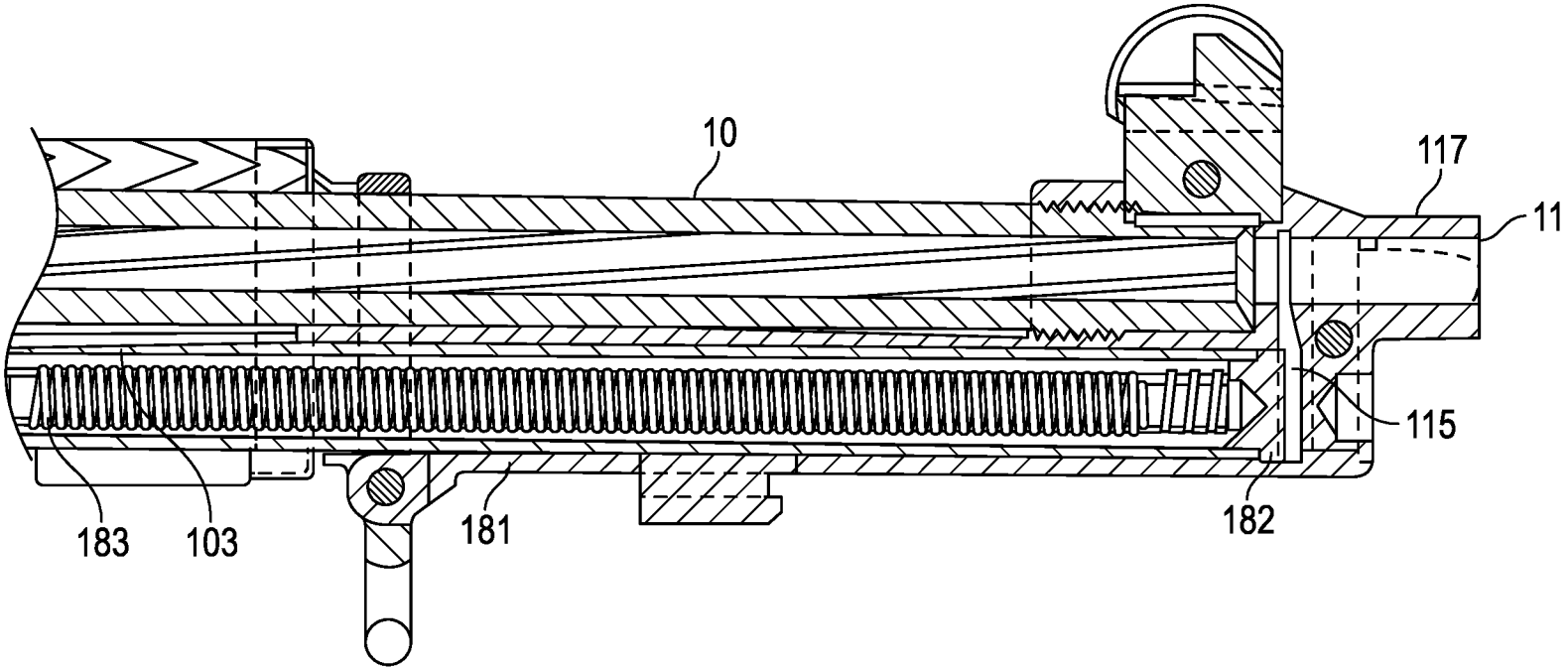
FIG. 3 is a cross-section view of a gas cylinder assembly.

FIG. 3 illustrates a cross section of the barrel group of a rifle 100. The barrel group 12 can include a barrel 10 and a gas cylinder assembly 114. The barrel 10 can have a muzzle 11 located at a distal end and be coupled to the receiver 105 at the proximal end. The muzzle 11 can be vented or unvented depending on the particular application and/or preference of the user. An unvented barrel (shown in FIG. 3) can be threaded for use with a sound suppressor, flash suppressor and/or the like.

In at least one instance, the barrel 10 and the gas cylinder assembly 114 can be a permanently coupled assembly. In other instances, the barrel 110 can be formed with a bevel 13 operable to orientate the gas cylinder assembly 114 during coupling between the gas cylinder assembly 114 and the barrel 10.

The barrel 10 and the gas cylinder assembly 114 can be coupled with the gas chamber 116. The barrel 110 can have one or more gas ports 115 formed therein and aligned with the gas chamber 116. The gas port 115 can be located substantially close to the muzzle 11. The gas cylinder assembly 114 can have a gas plug 118 at a distal end. During firing of the rifle 100, a portion of the propulsion gas is bled into the gas port 115 to actuate the gas cylinder assembly 114. The propulsion gas bled into the gas port 115 can compress the operating rod biasing element 183, thus actuating the operating rod 103 to draw the bolt 128 rearward. Following the release of the propulsion gas, the operating rod biasing element 183 draws the operating rod 103 forward again bringing the bolt 128 across the top of the magazine 54 and drawing a subsequent round into the chamber.

The operating rod biasing element 183 can be disposed around an operating rod biasing element guide 184. The operating rod biasing element guide 184 can have a protrusion and/or extension receivable into at least a portion the lower receiver 18 to assist in coupling and/or seating between the biasing element 183 and the upper receiver 18. The operating rod biasing element guide 184 protrusion can assist in locating, positioning, and/or securing the operating rod biasing element guide 184 during assembly and/or disassembly of the rifle 100. The protrusion can insure proper alignment of the operating rod biasing element guide 184 within the rifle 100, thus preventing deflection, bending and/or damage to the operating rod biasing element guide 184 during operation of the rifle 100. A modified standard M1 and/or M14 operating rod biasing element guide 184 could also be implemented.

The operating rod 103 can be positioned and/or received in an operating rod guide track 151 formed within the receiver 105. The operating rod guide track 151 can maintain the proper alignment and/or movement of the operating rod 103 during discharge and automatic reloading of the rifle 100.

Figure 4:
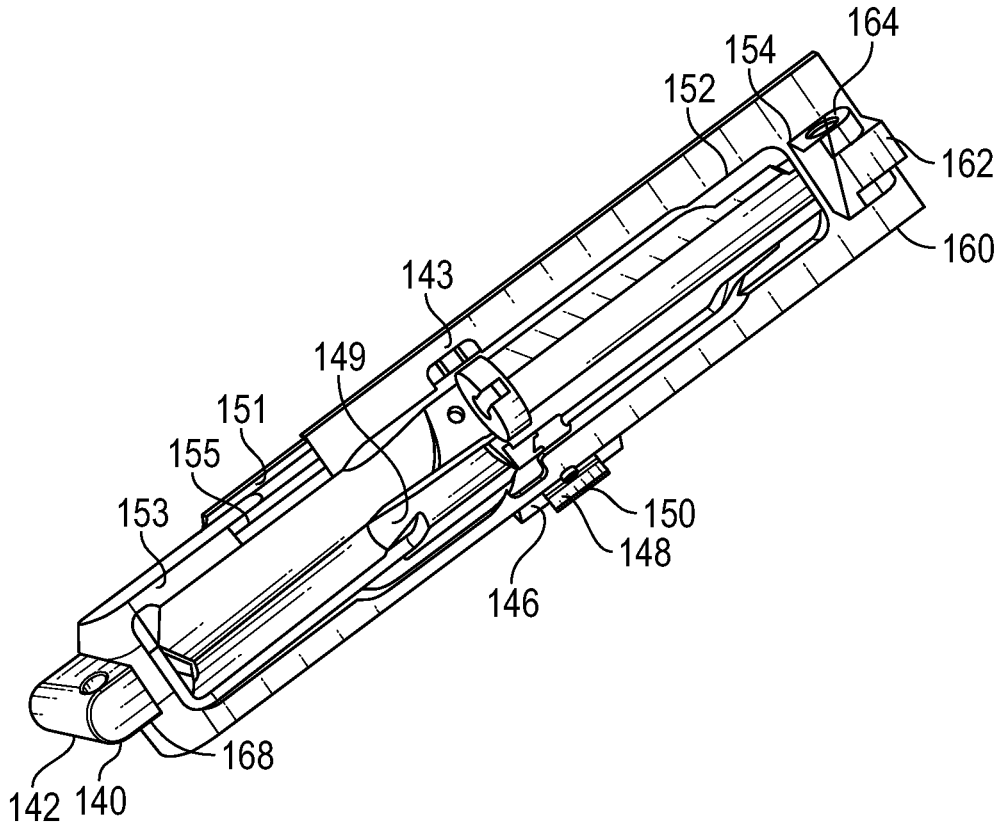
FIG. 4 is a bottom perspective view of a upper receiver of the semi-automatic rifle of FIG. 1.

FIG. 4 illustrates a bottom view of the receiver 105 decoupled from the barrel group 12 and hand guard assembly 107. An interior of the receiver 105 according to at least one instance can be simplified to reduce the amount of cores needed in a casting die, and/or machine operations needed if the part were machined from billet or forgings. The receiver 105 can reduce manufacturing time by approximately twenty-five to fifty percent (25-50%) due to reduction in production labor time. The bolt group 16 can be configured and/or adapted to slidably translate and/or rotate within the cavity formed by the receiver 105.

The receiver 105 of the present disclosure includes a "legless" safety bridge 40 operable to be pinned in the receiver 105 as a portion of receiver group 14. In some instances, the safety bridge 40 can be integrally formed within the receiver 105. In other instances, the safety bridge 40 can be pinned within the receiver 105 wherein the pin can be welded and/or otherwise semi-permanently installed therein. In yet other instances, the safety bridge 40 can be removable pinned within the receiver 105. The safety bridge 40 is described in more detail with respect to FIGS. 5 and 6.

The receiver 105 can be configured and/or adapted to provide a recess cooperatively engaged with a recess in the trigger assembly 20 to create a bolt receiving space 156. The bolt receiving space 156 can permit the bolt group 16 to slidably translate and/or rotate within the bolt receiving space 156, while also providing cam surfaces that cause the bolt group 16 to rotate into and/or out of alignment. This translating and rotating action locks a subsequent cartridge into place, unlocks a discharged cartridge casing and causes it to be expelled through the ejection port 126 of the receiver 105 (shown more clearly in FIGS. 1-2).

As can be appreciated in FIG. 4, the receiver 105 can include a guide track 144 and/or a clearance cut 149 for the bolt 128 (shown more clearly in FIGS. 1-2). The guide track 144 can allow the bolt 128 to track and/or move properly within the receiver 105 during firing and/or loading of the rifle 100. In at least one instance, the guide track 144 can be a groove formed in the inner sidewall of the receiver 105. The clearance cut 149 can allow the protrusions extending from the bolt 128 to actuate during operating of the rifle 100.

The receiver 105 can also include a magazine stop 152 to properly guide the magazine 54 to the proper alignment within the receiver 105. The magazine stop 152 can be a ridge extending from the inner sidewall of the receiver 105 to prevent the magazine 54 from being inserted further into the receiver 105. The magazine stop 152 can engage the sidewall of the magazine 54 to properly align the magazine 54 with the barrel 10 and bolt 128 for operation of the rifle 100. In at least one instance, the magazine stop 152 and the safety bridge 40 can collectively align and position the magazine 54 within the receiver 105. The magazine 54 can have a protrusion on the rear surface operable to abut the safety bridge 40 when the magazine 54 is properly positioned within the receiver 105 and when the magazine stop 152 engages the upper surface of the magazine 54.

The receiver 105 can further include a locking tab 148 having one or more bolt stops 146, 150 and an integral spring bias. The locking tab 148 and bolt stops 146, 150 can work collectively to stop the bolt 128 and/or operating rod 103 in the open position upon discharge of the last round in a magazine 54. The locking tab 148 can be held in a compressed position by the one or more rounds with the magazine 54, thus preventing the one or more bolt stops 146, 150 from engaging the bolt 128 and holding the bolt 128 in the open position. Upon discharge of the last round in the magazine 54, the spring bias can transition the locking tab 148 to place the one or more bolt stops 146, 150 into the path of the bolt 128, thus holding the bolt 128 open.

The receiver 105 can be threaded 154 at a front end 160 for rotational attachment to the barrel group 12. In at least one instance, the barrel 10 can have an engagement feature to assist coupling with the threaded 154 portion of the receiver 105. The engagement feature can be a desired shape (for example, hexagonal surfaces) for engagement with a tool (for example, a wrench).

The receiver 105 includes at least one optics rail 190. In at least one instance, the optics rail 190 can be coplanar with a rail on the hand guard assembly 107, thus forming an accessory rail 110. The optical sights can be mounted to the optics rail 190 of the receiver 105 by way of lugs, which can be recessed into the receiver 105. Additionally, the lugs 192 can be configured and adapted such that the lugs 192 bear the load of the optical sights and screws are used to secure the optical sights vertically to the receiver 105. Optical sights can be mounted in a flat configuration or in a sloped configuration depending on the range that the operator desires to sight.

In at least one embodiment, the receiver 105 can be manufactured of finished 17-4 (or other similar suitable materials) stainless steel through one of a variety of well-known manufacturing processes. The receiver 105 can be hammer forged, machined from a billet, investment cast or manufactured from an additive manufacturing process. The receiver 105 can be hardened by way of a precipitation hardening process or other commonly acceptable practices depending on the material used, to the hardness needed to attach the desired strength and wear performance for the part. In at least one embodiment, the hardening of the receiver 105 can be to approximately 40 to 42 Rockwell C hardness. In at least one embodiment, the receiver 105 can further be treated with a nitride treatment, as described above.

Figure 6:
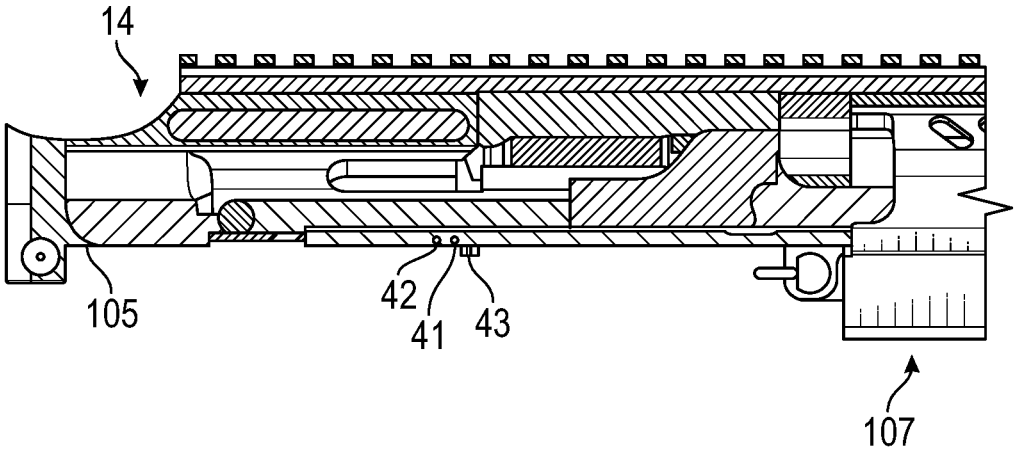
FIG. 6 is an assembled view of the upper receiver of FIG. 6.

FIG. 6 illustrates an assembled view of the receiver group 14. The safety bridge 40 can be positioned within the receiver 105 and aligned by one or more wings 43. The one or more wings 43 can be received within a bridge cavity 143 formed within the receiver 105. Proper alignment between the receiver 105 and the safety bridge 40 can allow securement of the safety bridge 40 to the receiver 105. The bridge cavity 143 can assist in preventing movement, translation, and/or rotation of the safety bridge 40 through engagement with the one or more wings 43 extending from the bridge 40.

In at least one instance, the safety bridge 40 can be mounted and/or secured within the receiver 105 by one or more pins 41, 42. The one or more pins 41, 42 can be press fit through corresponding apertures formed in the receiver 105, thereby securing the safety bridge 40 within the receiver 105. In at least one instance, the pins 41, 42 can be spot welded, ultrasonic welded, or otherwise secured to the receiver 105 to prevent removal of the safety bridge 40. In other instances, the pins 41, 42 can be press-fit while allowing removal, thus the safety bridge 40 can be removable from the receiver 105.

Figure 5:
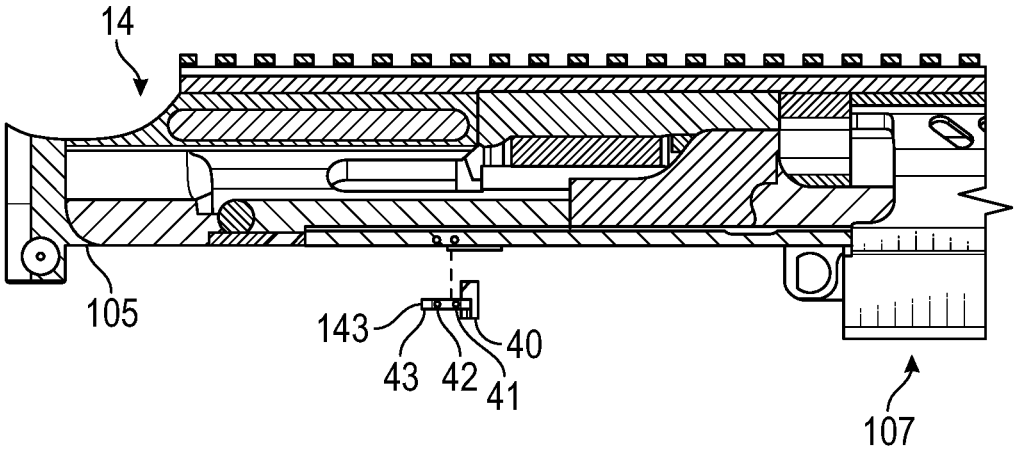
FIG. 5 is an exploded view of the upper receiver of FIG. 1.

While FIGS. 5 and 6 illustrates two horizontally aligned pins 41, 42 securing the safety bridge 40, any number of pins in any arrangement sized and positioned appropriately can be used to secure the safety bridge 40 within the receiver 105.

The safety bridge 40 can be coupled to the receiver group 14 by way of pins 41, 42 or other similar attachments. In at least one instance, the safety bridge 40 can be removably coupled with the receiver 105. The advantage of this removable bridge 40, which is subject to significant wear, can be easily replaced and cheaply manufactured, thus extending the useful life of the semi-automatic rifle 100. Further, the manufacture of the receiver 105 and the bridge 40 can be greatly reduced. The safety bridge 40 can be coupled with the receiver 105 in any removable fashion sufficient to withstand the forces applied by the firing of the rifle and fire control mechanisms. The coupling mechanism can vary based on caliber implemented with the semi-automatic rifle 100.

In other instances, the safety bridge 40 can be integrally formed within the receiver 105.

The one or more wings 43 of the safety bridge 40 can be configured to be received within the bridge cavities 143 forming a substantially flush surface with a bottom surface 153 of the receiver 105 when secured therein.

The bottom surface 153 of the receiver 105 can be operable to be abuttingly mated to the lower receiver 18 (shown in FIG. 1). The bottom surface 153 can have groove 155 formed therein to receive an operating rod retention tab 174 when coupled thereto. The groove 155 can be formed in the bottom surface 153 in the operating rod guide track 151 formed in the receiver 105. The operating rod guide track 151 (shown in FIGS. 1-2) can allow the operating rod 103 to properly transition during firing of the rifle 100. The groove 155 can facilitate removal of the operating rod 103 from the rifle 100 during cleaning and/or maintenance, thereby reducing the likelihood the operating rod 103 is bent during disassembly and/or removal. Conventional M1 and/or M14 rifles can include a notch in the upper portion of the operating rod guide track 151; however, the notch requires rotation of the operating rod 103 to properly removal leading to bending/torquing of the operating rod 103. A bent/torqued operating rod 103 must be replaced and will prevent proper operation of the rifle 100.

The coupling and decoupling of the upper receiver 105 and the lower receiver 18 allows the groove 155 formed in the bottom surface 153 of the upper receiver 105 to provide access to and easy removal of the operating rod 103 without risk of bending, twisting, and/or torque of the operating rod 103, thereby preventing damage to the operating rod 103.

Figure 7:
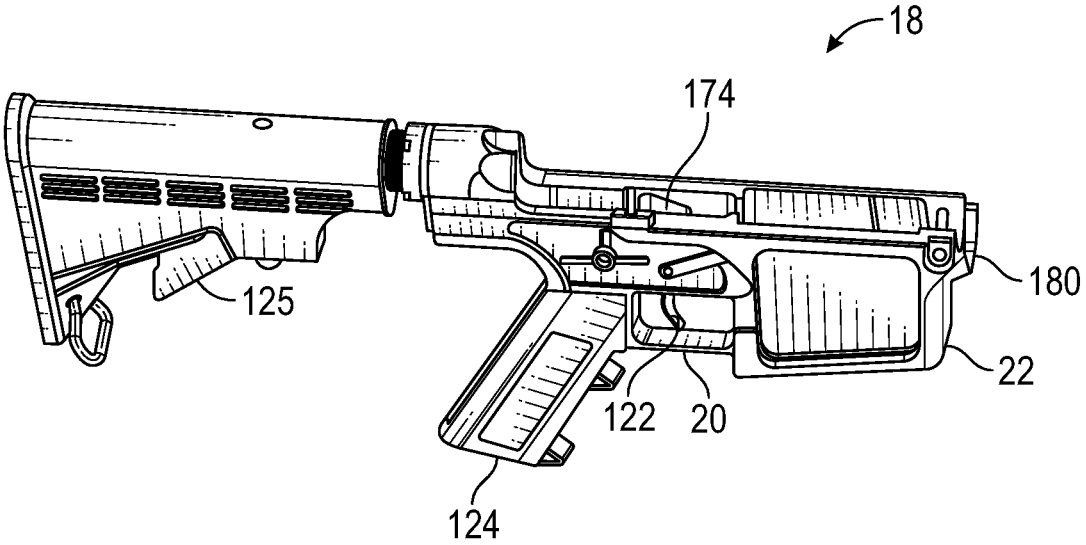
FIG. 7 is a perspective view of a lower receiver of the semi-automatic rifle of FIG. 1.

FIG. 7 illustrates the lower receiver 18 of the rifle 100. The lower receiver 18 can also include a portion of the operating rod spring guide track 151. The operating rod spring guide track 151 can receive the operating rod spring guide (shown more clearly in FIG. 8) into the lower receiver 18 and ensure proper movement of the operating rod 103 during firing of the rifle 100.

The lower receiver 18 can include an operating rod retention tab 174 coupled to and/or integrally formed in the upper surface 172 of the lower receiver 18. The operating rod retention tab 174 can be matingly received into the groove 155 formed in the bottom surface 153 of the upper receiver 105. The operating rod retention tab 174 can prevent removal of the operating rod 103 when matingly received in the groove 155. The operating rod retention tab 174 can be separably formed and coupled with the lower receiver 18 via press-fit pin, welding, or other attachment. In other instances, the operating rod retention tab 174 can be integrally formed with the lower receiver 18.

In at least one instance, the operating rod retention tab 174 is formed from steel like the upper receiver 105 and the lower receiver 18 is formed from aluminum and/or polymer. In other instances, the operating rod retention tab 174 and the lower receiver 18 can be formed from the same material.

The lower receiver assembly 18 further includes the magazine well 120. The magazine well is appropriately configured and adapted to receive box-style magazines corresponding to the caliber of the rifle 100. Accordingly, the magazine well 120 can be configured and adapted to accommodate magazines of a desired size. The magazines can be locked into place and released using a magazine release system. The magazine well 120 of the lower receiver 18 can be pitched toward the rear of the rifle 100 relative to an axis perpendicular to the barrel 10. The magazine well 120 can be pitched rearward approximately 5 degrees to allow proper engagement between the magazine 54 and the bolt 128.

The lower receiver 18 also houses the trigger group 20. In at least one embodiment, the trigger group 20 of the semi-automatic rifle 100 is of the AR15/M16 variety. The trigger mechanism of the trigger group 20 can be of the precision trigger variety. The grip 124 of the semi-automatic rifle 100 can be a pistol-type grip or any other commercially available grip for the AR platform.

The butt stock 125 of the semi-automatic rifle 100 can be removably coupled to the trigger assembly 20. The coupling of the butt stock 125 to the trigger assembly 20 can be configured such that the stock is in line with the bore of the barrel thereby enhancing the accuracy of the rifle. In at least one embodiment, the butt stock 125 can be any COTS butt stock configured for use on an AR-15 platform including, but not limited to, collapsible stocks and folding stocks.

The stock 125 can be made of carbon fiber, wood, aluminum or other similar light-weight materials. Additionally, the stock can be of the folding or collapsing varieties because the semi-automatic rifle 100 does not require a buffer or buffer tube. Accordingly, when a folding or collapsible stock is put in the folded or collapsed position, respectively, the overall length of the semi-automatic rifle 100 can be relatively short, while maintaining a significant barrel length. This configuration allows a higher muzzle velocity of the rounds fired, thus the rifle is more accurate than shorter barrel configurations. Further, the lack of a buffer or buffer tube allows the rifle 100 to be fired with the collapsible/folding stock in the collapsed/folded position or rifle 100 can be implemented with a stock 125 omitted.

The lower receiver 18 can be configured to receive at least a portion of a firing pin bridge 40 therein. The firing pin bridge 40 can be secured to the upper receiver group 14 and at least partially received by the lower receiver 18 upon coupling between the lower receiver 18 and the upper receiver 105. In at least one embodiment, the trigger assembly can include a groove or cavity configured to receive and align the safety pin bridge 40 therein.

As can be appreciated in FIG. 7, the safety bridge 40 can be at least partially received within the trigger assembly 20. The one or more wings 43 of the safety bridge 40 can be configured to engage in a substantially flush manner with the upper surface of the trigger assembly 20. In an assembled semi-automatic rifle 100, the one or more wings 43 of the safety bridge can be sandwiched between the trigger assembly 20 and the receiver group 14 with the one or more wings received in the bridge cavity 143.

As discussed above, the safety bridge 40 can further engage with a protrusion 56 extending from the rear surface of a magazine 54 to properly align the magazine 54. The protrusion 56 can assist in aligning the magazine 54 within the magazine well 120. Further, the magazine well 120 must be aligned and/or pitched to position the protrusion 56 abuttingly engaged with the bottom surface of the safety bridge 40.

The lower receiver 18 can further couple with or integrate any magazine release, a safety/fire control selection, grip 124 and/or butt stock 125 designed for the AR platform. The interchangeable and customization elements of the lower receiver 18 can provide a user the ability to use readily available AR-style platform parts with the rifle 100.

The lower receiver 18 further includes a retention shelf 180 operable to engage with the hand guard assembly 107. The retention shelf 180 can engage with the one or more access points 109 of the hand guard assembly 107 to secure the access points 109 to a closed position when the lower receiver 18 is coupled with the upper receiver 105. The retention shelf 180 can prevent pivoting, sliding, or other access via the one or more access points 109 when the rifle 100 is assembled, while also preventing incidental opening of the one or more access points 109 during operation of the rifle 100.

Figure 8:
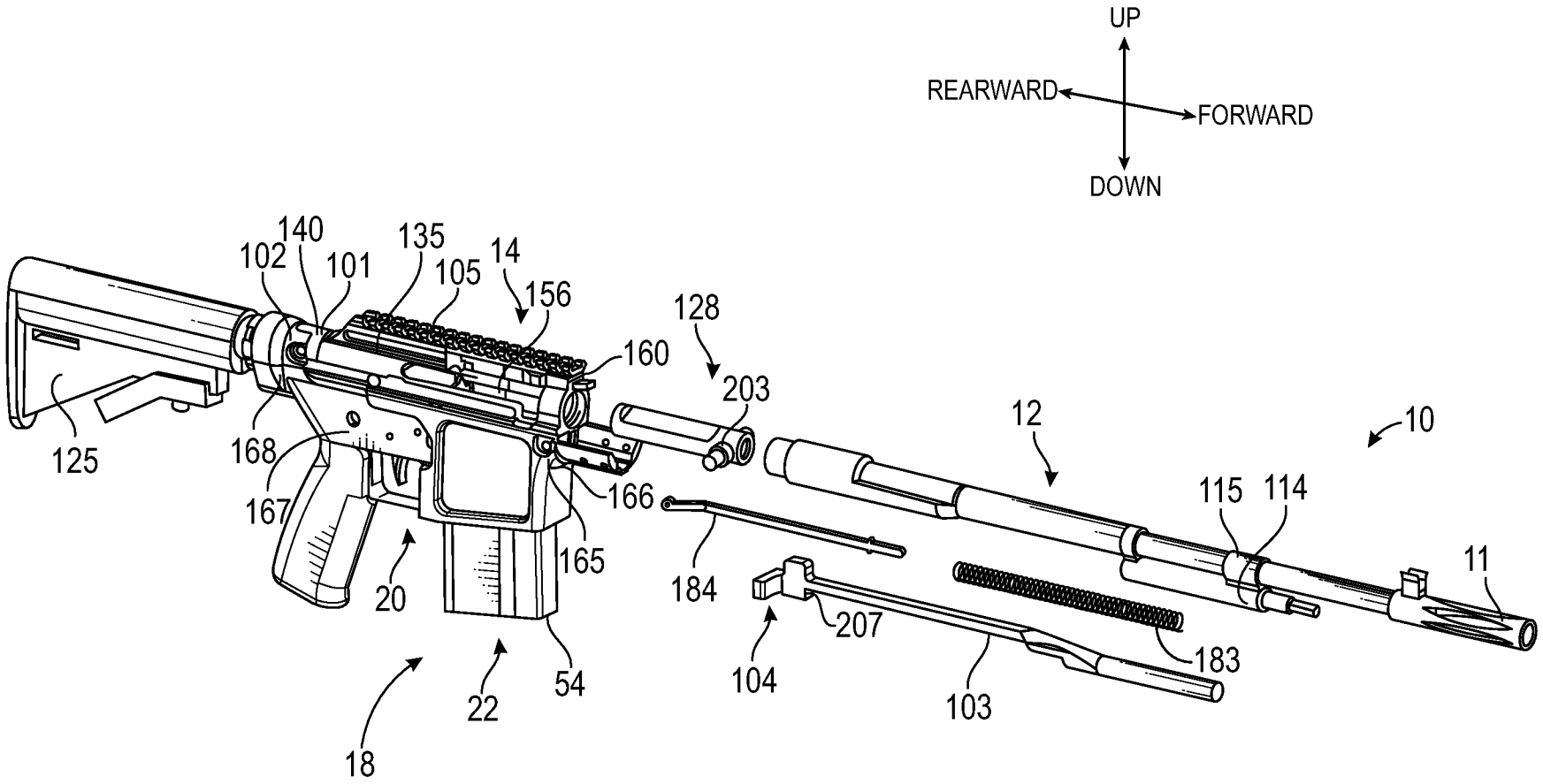
FIG. 8 is an exploded view of a rifle having a hand guard assembly removed.

FIG. 8 illustrates an exploded view of the rifle without a hand guard assembly. The bolt 128 can have outwardly facing protrusion 203 extending from an exterior surface. The protrusion 203 can be received in a receiving portion 207 of an operating rod 103, thereby coupling the bolt 128 with the operating rod 103. The operating rod 103 can also include a handle 104 configured to actuate the operating rod 103. As can be appreciated in FIG. 8, the handle 104 is an outwardly extending protrusion. In other embodiments, the handle 104 can be curved to increase the ergonomics during operating of the semi-automatic rifle 100. The actuation of the operating rod 103, either by the handle 104 or by firing of the rifle 100, can actuate the bolt 128 within the bolt receiving space 156.

As can be appreciated in FIG. 8, the operating rod 103 can also be coupled to an operating rod biasing element guide 184. A biasing element 183 can be interposed between the operating rod 103 and the operating rod biasing element guide 184. The biasing element 183 can bias the operating rod 183 toward the muzzle 11. While the illustrated embodiment is discussed with respect to a biasing element guide 184 and biasing element 183, the operating rod 103 can be coupled to an operating rod guide biased by any biasing element known in the art including, but not limited to, a spring.

FIGS. 9A and 9B illustrates a hand guard assembly. The hand guard assembly 107 can be disposed over at least a portion of the barrel 10, operating rod 103, biasing element 183, and/or gas cylinder assembly 114. The hand guard assembly 107 can additionally incorporate perforations 108 or openings to assist the air-cooling of the barrel 10 and the gas-cylinder system 114. The perforations 108 can assist with air-cooling of the barrel 10 along with reducing the overall weight of the semi-automatic rifle 100 through the removal of material. While the present disclosure generally details the perforations as slots, it is within the scope of this disclosure to implement any shape, polygon, and/or pattern.

The hand guard assembly 107 can include one or more access points 109 operable when the hand guard assembly 107 is not engaged with the retention shelf. The one or more access points 109 can allow field cleaning of the rifle 100 including, but not limited to, removal of the operating rod 103, the biasing element 183, and/or the biasing element guide 184. The one or more access points 109 can be pivoting and/or sliding portions of the hand guard 107 and can include perforations 108 and/or accessory rails 110.

In at least one instance, the hand guard assembly 107 can include M-Loc style apertures formed in one or more surface to accommodate coupling of M-Loc designed accessories including, but not limited to, bi-pods. In other instances, the hand guard assembly 107 can include Key-Mod or any other commercially available style aperture to receive accessories. In yet other instances, the hand guard assembly 107 can include any combination of M-Lock, Key-Mod, and/or other commercially available style apertures.

The hand guard assembly 107 can be any length relative to the barrel 10. In at least one instance, the hand guard assembly 107 extends substantially the length of the barrel 10. In other instances, the hand guard assembly 107 extends to the distal end of the biasing element 183. Handguard assemblies 107 that do not extend and/or cover the gas cylinder system 114 an additional protective tube can be implemented to protect a user from the actuation of one or more elements (for example, the gas cylinder assembly) generated by discharge of the rifle 100. The protective tube can be threaded or otherwise coupled with the biasing element guide 184.

The one or more access points 109 can include one or more clasps 113 operable to actuate the one or more access points 109 between an open and closed position. The one or more clasps 113 can be configured to maintain a closed position when the rifle 100 is disassembled. The one or more claps 113 can have a biasing element operable to bias the clasp 113 to a closed position. While the present disclosure is drawn to one or more clasps 113 actuating the one or more access points 109 between the open position and the closed position, it is within the close of the present disclosure to implement any fixing device operable to secure the access point 109 including, but not limited to, clasps, magnets, pressure fit, tongue and groove, or combinations thereof.

Figure 10:
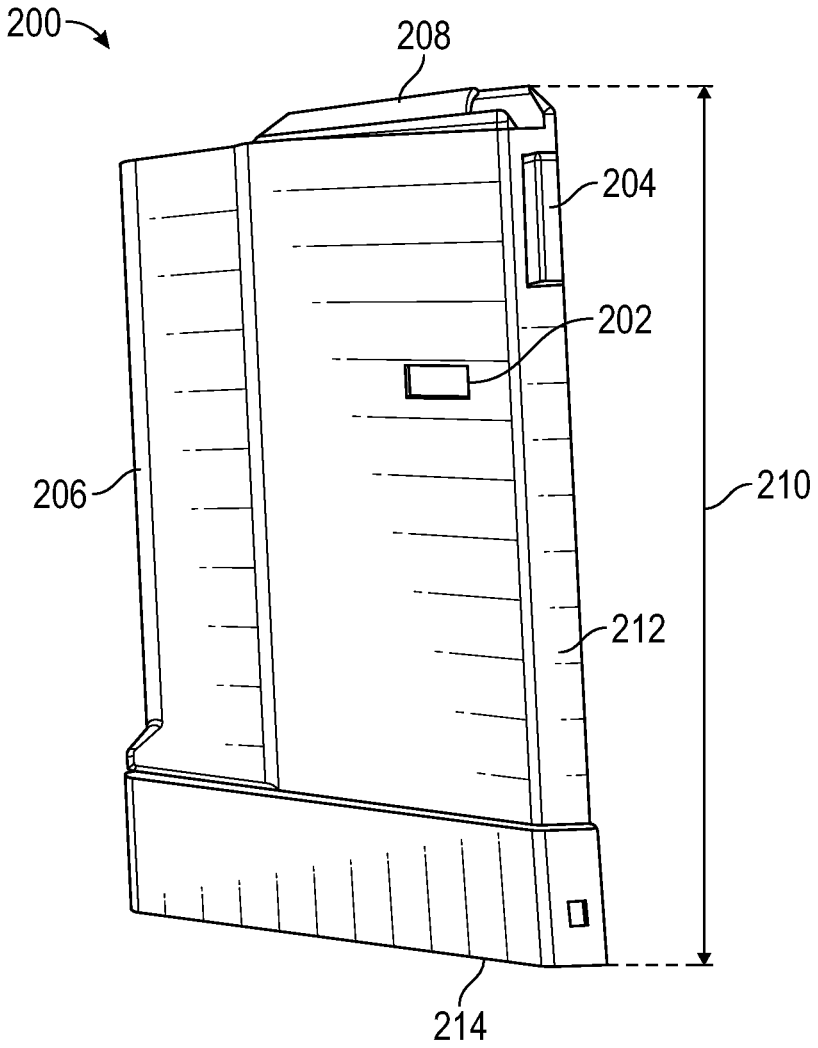
FIG. 10 is a rear isomeric view of a magazine for a semi-automatic rifle according to at least one example of the present disclosure.
Figure 11:
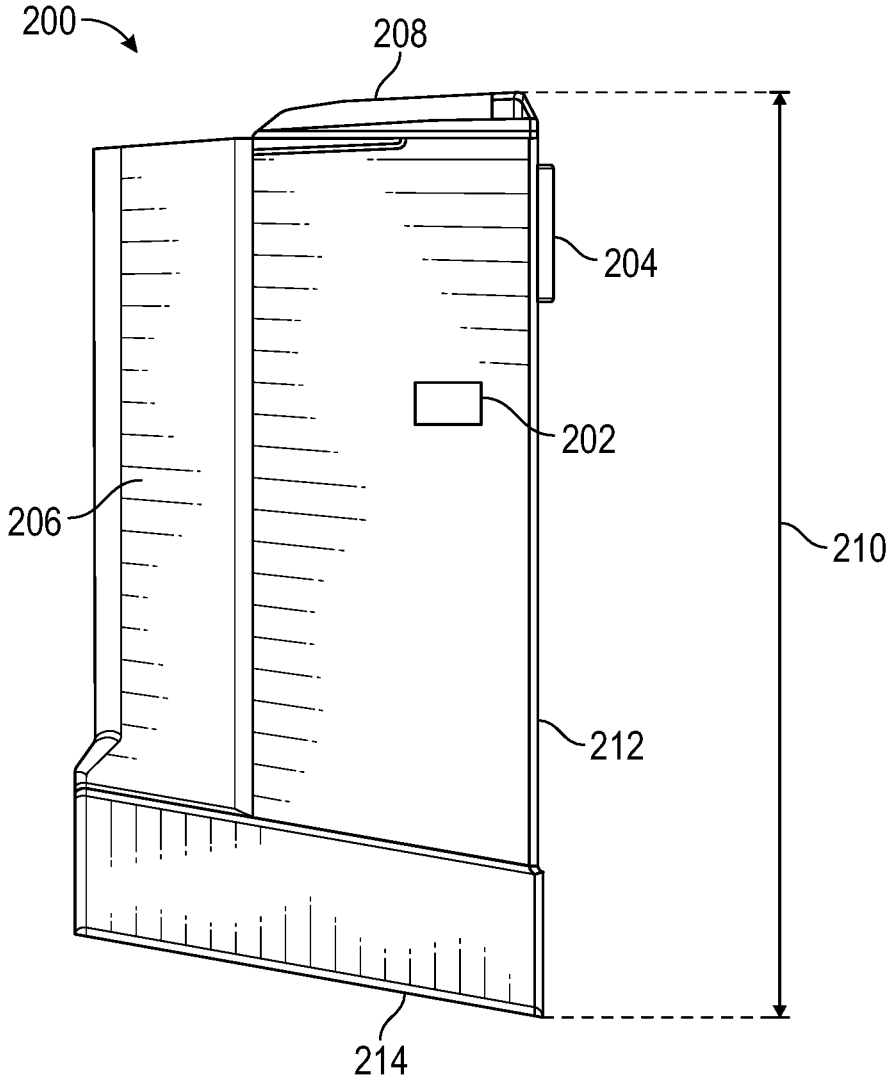
FIG. 11 is a left plan view of a magazine for a semi-automatic rifle according to at least one example of the present disclosure.

FIG. 10 is a magazine couplable with a rifle 100 according to at least one example of the present disclosure. FIG. 11 is a plan view of a magazine couplable with the semi-automatic rifle. The magazine 200 can be operable to couple with an AR style receiver and operably engage with the bolt 128 of an M1 rifle within the rifle 100. The magazine 200 can be a modified "box-style" magazine originally for use with an M1 rifle.

Previously manufactured, unmodified box-style magazines for an M1/M14 cannot engage with an AR style receiver, and therefore the magazine cannot be retained within the magazine well. Existing AR style magazines are not designed and are unable to interact with the bolt 128, and cannot fit (be retained) within the magazine well, thus sequential cartridges cannot be removed from the magazine and loaded into battery of the semi-automatic rifle 100.

The magazine 200 can have an engagement feature 202 formed on a left sidewall 206 thereof for engagement with and coupling to the receiver 105. In at least one instance, the engagement feature 202 is substantially rectangular. A substantially rectangular engagement feature 202 can be operable to engage with a MilSpec magazine release engagement member. In other instances, the engagement feature 202 can be any shape and/or size operable to engage with the corresponding engagement member of the magazine release.

The engagement member can be an extending locking member operable to be received into and engage with the engagement feature 202, thus operably engaging the magazine 200 within the receiver 105. While the present disclosure is drawn specifically to a substantially rectangular engagement member 202, it is within the scope of this disclosure to vary size and/or shape of the engagement feature 202 sufficient to securely engage the box-style magazine with the AR type receiver. In at least one instance, the engagement feature 202 is substantially rectangular and has side edges that are rounded and/or curved to aid in machining. The top and bottom edges can be substantially linear and parallel to each other.

The engagement feature 202 can be a groove, depression, aperture, slot, and/or any other feature operable to engage with the engagement feature of the magazine well 120. In some instances, the engagement feature 202 can be an aperture formed within the sidewall 206 operable to receive the engagement member extending from the magazine well 120 of the semi-automatic rifle. In other instances, the engagement feature 202 can extend only partially through the sidewall 206 of the magazine 200, thus forming a depression, groove, and/or slot. In at least one instance, the engagement feature 202 can be formed in the sidewall 206 of the magazine 200 by a computer numerical control (CNC) machine. In other instances, the engagement feature 202 can be formed by a hydraulic punch, laser cut, water cut, abrasive wheel cutter, and/or combinations thereof.

The engagement feature 202 is precisely positioned on the left sidewall 206 corresponding to the magazine 200 being properly aligned and positioned within the magazine well 120 and operably engageable with the bolt 128. The engagement feature 202 can work in conjunction with the corresponding alignment feature 204 to properly position the magazine 200 within the magazine well 120. The engagement feature 202 is positioned at a sufficient height (along the vertical axis) to ensure that the magazine 200 is sufficiently received into the magazine well 120 for the bolt 128 to extract a cartridge from the magazine 200 during operation of the semi-automatic rifle 100.

The engagement feature 202 can be positioned in the same location relative to a top surface 208 of the magazine 200 irrespective of the total height 210 of the magazine. The magazine 200 can be configured to hold any number of cartridges including, but not limited to, 10 cartridges, 20 cartridges, 30 cartridges, or any other number of cartridges. The engagement feature 202 is positioned in the same location to the top surface 208, thus the magazine 200 extends further beyond the magazine well 120 as the height 210 is increased.

Previously manufactured box-style magazines can be modified, adapted, and/or otherwise retrofitted to include a correctly positioned engagement feature 202 to operably engage with the semi-automatic rifle 100, as explained in more detail below with respect to FIG. 4. The previously manufactured magazines can be modified to include the engagement feature 202, thus being capable of engaging with the receiver 105 of the semi-automatic rifle 100. The modification, adaptation, and/or retrofitting of the previously manufactured magazines does not prevent use within an M1 style rifle, however an unmodified, adapted, or otherwise retrofitted magazine is incapable of engagement with and operation with the semi-automatic rifle 100.

The magazine 200 can include a correspondingly shaped alignment feature 204 operable to interact with the alignment feature 121 of the magazine well 120. The correspondingly shaped alignment feature 204 can be a tongue, groove, or any shape to correspondingly engage with the alignment feature 121. In at least one instance, the correspondingly shaped alignment feature 204 can be a tongue extending away from rear surface 212 of the magazine and extending at least a portion of the height 210. The correspondingly shaped alignment feature 204 can be received within a groove formed as the alignment feature 121 on the magazine well 120.

The magazine 200 can include a base plate 214 forming a bottom surface. The magazine 200 can be operate to receive a biasing element (for example, compression spring) to urge cartridges toward the receiver 105 and bolt 128 upon removal of a preceding cartridge. The magazine 200 can also include a follower (not shown) to insure the biasing element urges the cartridge to the appropriate position with respect to the receiver 105 and/or the bolt 128.

Figure 12:
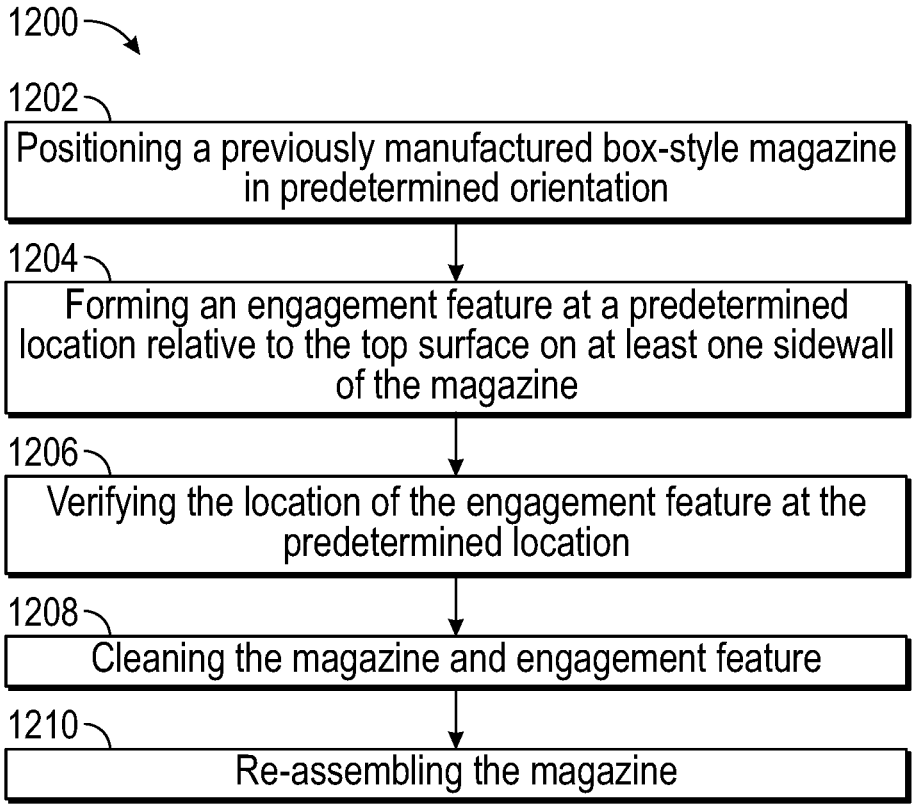
FIG. 12 is a flow chart of a retro-fit method for a magazine for a semi-automatic rifle according to at least example of the present disclosure.

Referring to FIG. 12, a flowchart is presented in accordance with an example method. The example method 400 is provided by way of example, as there are a variety of ways to carry out the method 1200. Each block shown in FIG. 12 represents one or more processes, methods, or subroutines, carried out in the example method 1200. Furthermore, the illustrated order of blocks is illustrative only and the order of the blocks can change according to the present disclosure. Additional blocks may be added or fewer blocks can be utilized, without deviating from the present disclosure. The example method 1200 can begin at block 1202.

At block 1202, a box-style magazine 200 can be positioned with a retrofit tool apparatus. The magazine 200 can be a used, recycled, rebuilt, and/or new box-style magazine for use with an M1 semi-automatic rifle. The magazine 200 can be positioned within a retrofit too apparatus in a predetermined orientation. In at least one instance, the predetermined orientation is the left sidewall 206 facing upward. In other instances, the predetermined orientation can be the left sidewall facing downward. In yet other instances, the predetermined orientation can be any orientation and/or positioning of the magazine 200.

At block 1204, the retrofit tool apparatus can form an engagement feature 202 within a sidewall of the magazine 200. The retrofit tool apparatus can punch, machine, cut, grind, and/or otherwise form the engagement feature 202. In at least one instance, the retrofit tool apparatus can form an aperture in the left sidewall 206 of the magazine 200.

At block 1206, the magazine 200 can be checked for proper positioning and formation of the engagement feature 202. The engagement feature 202 can be checked for proper size, positioning and/or arrangement on the magazine 200 within a predefined tolerance or variance from the desired predetermined location. In at least one instance, a sample engagement member can engage with and release the engagement feature 202 to insure proper positioning and/or arrangement. Improperly positioned and/or arranged engagement feature 202 can be discarded for additional modification or scrap. In at least one instance, method can return to block 1202 for reforming the engagement feature.

At block 1208, the magazine 200 can be cleaned. The magazine 200 can be cleaned for debris or foreign matter as a result of the engagement feature 202 formation. The cleaning can include, but is not limited to, filing, sanding, pneumatic air blast, vacuuming, and/or other cleaning steps to reduce sharp edges and/or remove foreign containments from the magazine 200.

At block 1210, the magazine 200 can be re-assembled. In some instances, the magazine 200 can be disassembled during formation of the engagement feature 202 to prevent damage from internal components. Disassembly and/or reassembly of the magazine can include, but is not limited to, removal of compression spring, base plate, and/or follower. Upon formation of the engagement feature 202 and the cleaning the magazine of foreign matter, the magazine 200 can be re-assembled.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. Rather, the described features and steps are disclosed as possible components of systems and methods within the scope of the appended claims.

Statement Bank

Statement 1: A lower receiver assembly of a rifle comprising: a lower receiver having a magazine well-formed thereon between a distal end and a proximal end, the lower receiver operable to receive a trigger assembly including a trigger, a hammer, and a firing pin, the lower receiver having a recoil lug pocket operable to engage at least a portion an upper receiver; an operating rod retention tab coupled with an upper surface of the receiver, wherein the operating rod retention tab extends above the upper surface and is operable to be received in a groove formed in a receiver of the upper receiver.

Statement 2: The lower receiver assembly of Statement 1, wherein the operating rod retention tab is integrally formed with the lower receiver.

Statement 3: The lower receiver assembly of Statement 1 or Statement 2, wherein the operating rod retention tab is coupled with the lower receiver by one or more press fit pins.

Statement 4: The lower receiver assembly of any one of Statements 1-3, wherein the operating rod retention tab is formed from steel and the lower receiver is formed from aluminum and/or polymers.

Statement 5: The lower receiver assembly of any one of Statements 1-4, wherein magazine well coupled with the lower receiver and angled at least five (5) degrees relative to a vertical axis toward the proximal end of the receiver.

Statement 6: The lower receiver assembly of any one of Statements 1-5, wherein the magazine well has one or more grooves operable to engage with a box-style magazine.

Statement 7: The lower receiver assembly of any one of Statements 1-6, wherein the distal end of the lower receiver includes a retention shelf operable to engage with a hand guard assembly.

Statement 8: The lower receiver assembly of any one of Statements 1-7, wherein the retention shelf is operable to receive at least a portion of an access point disposed on a hand guard assembly.

Statement 9: The lower receiver assembly of any one of Statements 1-8, wherein the lower receiver is operably engaged with a collapsible and/or folding buttstock.

Statement 10: The lower receiver assembly of any one of Statements 1-9, wherein the magazine well is pitched rearward approximately five degrees relative to a vertical axis.

Statement 11: The lower receiver assembly of any one of Statements 1-10, wherein the magazine well includes a groove operable to receive a corresponding protrusion extending from a magazine.

Statement 12: The lower receiver assembly of any one of Statements 1-11, wherein the magazine well includes an engagement member operable to engage an engagement feature on a magazine.

Statement 13: The lower receiver of any one of Statements 1-12, wherein the recoil lug pocket has an aperture therein operable to receive a takedown pin therein.

Statement 14: The lower receiver of any one of Statements 1-13, wherein the takedown pin is a press-fit pin operable to be received through at least a portion of the upper receiver.

Statement 15: The lower receiver of any one of Statements 1-14, wherein the lower receiver further comprises a pivot pin operably received therein, and laterally displaced from a takedown pin.

Statement 16: The lower receiver of any one of Statements 1-15, wherein the recoil lug is operable to receive a takedown pin therein and is disposed rearward of the magazine well, and a pivot pit is disposed forward of the magazine well, the takedown and the pivot pin operable to engage at least a portion of the upper receiver.

Statement 17: A lower receiver comprising: a lower receiver having a magazine well-formed thereon between a distal end and a proximal end, the lower receiver operable to receive a trigger assembly including a trigger, a hammer, and a firing pin, the lower receiver having a recoil lug pocket operable to engage at least a portion an upper receiver; wherein the recoil lug pocket is operable to receive a takedown pin therein, the takedown pin extending substantially laterally across the lower receiver.

Statement 18: The lower receiver of Statement 17, further comprising an operating rod retention tab coupled with an upper surface of the receiver, wherein the operating rod retention tab extends above the upper surface and is operable to be received in a groove formed in a receiver of the upper receiver.

Statement 19: The lower receiver of Statement 17 or Statement 18, wherein the operating rod retention tab is integrally formed with the lower receiver.

Statement 20: The lower receiver of any one of Statements 17-19, wherein the operating rod retention tab is formed from steel and the lower receiver is formed from aluminum and/or polymers.

Statement 21. A method comprising: positioning a previously manufactured M1/M14 box-style magazine in a predetermined orientation; forming a substantially rectangular engagement feature at a predetermined location relative to the top and rear surfaces on at least one sidewall of the magazine; and verifying the location of the engagement feature at the predetermined location.

Statement 22: The method of Statement 21, further comprising cleaning the magazine to remove any foreign matter or particular created during formation of the engagement feature.

Statement 23: The method of Statement 21 or Statement 22, wherein cleaning the magazine includes smoothing one or more edges of the engagement feature.

Statement 24: The method of any one of Statements 21-23, further comprising disassembling the magazine prior to positioning the magazine.

Statement 25: The method of any one of Statements 21-24, further comprising re-assembling the magazine after verifying the location of the engagement feature.

Statement 26: The method of any one of Statements 21-25, wherein verifying the location of the engagement feature determines whether the engagement feature was formed at the predetermined location within a predefined tolerance.

Statement 27: The method of any one of Statements 21-26, further comprising reforming the engagement feature at the predetermined location relative to the top surface.

Statement 28: The method of any one of Statements 21-27, further comprising verifying the location of the reformed engagement feature at the predetermined location.

Statement 29: The method of any one of Statements 21-28, wherein forming the engagement feature is a punch forming an aperture through the at least one side of the magazine.

Statement 30: The method of any one of Statements 21-29, wherein the engagement feature is an aperture formed on the left sidewall of the magazine.

What is claimed is:

1. A method of modifying a magazine operable to be coupled with a firearm, the method comprising:

at least partially disassembling a functioning box style magazine by removing one or more components, such that it forms a disassembled magazine;

positioning at least one side wall of the disassembled magazine in a predetermined orientation;

forming an engagement feature at a predetermined location relative to a top surface on at least one sidewall of the disassembled magazine, wherein the engagement feature is a through hole aperture; and, constructing a modified magazine by installing the one or more removed components into the disassembled magazine that includes the engagement feature.

2. The method of claim 1, further comprising coupling said modified magazine to an AR style lower receiver.

3. The method of claim 1, further comprising finishing the engagement feature.

4. The method of claim 3, wherein finishing the engagement feature includes one or more of filing, sanding, polishing, pneumatic air blasting and/or vacuuming to reduce sharp edges and remove foreign contaminants.

5. The method of claim 1, wherein at least partially disassembling includes removal of at least one of a removal of a compression spring, base plate, and/or follower.

6. The method of claim 1, wherein constructing the modified magazine includes installing at least one of a compression spring, base plate, and/or follower.

7. The method of claim 1, wherein the at least one engagement feature is formed by at least one of hydraulic punching, laser cutting, fluid cutting, and/or abrasive wheel cutting.

8. An AR style rifle assembly comprising:

an upper receiver group;

an AR style lower receiver group comprising a magazine well;

a barrel group;

a trigger group; and, a magazine group comprising a modified magazine as recited in claim 1, wherein the magazine well is operable to receive the modified magazine.

9. The AR style rifle assembly of claim 8, wherein said at least one engagement feature was formed by at least one of a hydraulic punch, laser cutter, fluid cutter, and/or abrasive wheel cutter.

10. The AR style rifle assembly of claim 8, wherein said at least one engagement feature was formed as at least one of a groove, depressions, aperture and/or slot.

11. The AR style rifle assembly of claim 8, further comprising an alignment feature.

12. The AR style rifle assembly of claim 8, wherein the AR style lower receiver group further comprises a lower receiver, and the magazine well is angled at least five degrees relative to a vertical axis toward a proximal end of the lower receiver.

13. The AR style rifle assembly of claim 9, wherein the magazine well includes one or more grooves operable to engage with a corresponding one or more protrusion on the magazine.

14. The AR style rifle assembly of claim 8, wherein the magazine well includes an engagement member operable to engage with the engagement feature.

15. The AR style rifle assembly of claim 8, further comprising a safety bridge configured to engage with a protrusion extending from a rear surface of the magazine, thereby properly aligning the magazine.

16. The AR style rifle assembly of claim 15, wherein the magazine well is pitched to position the protrusion abuttingly engaged with a bottom surface of the safety bridge.

17. A modified box style magazine comprising:

a compression spring, a base plate, a follower, at least one sidewall having a top surface, wherein at least one sidewall further comprises an engagement feature formed according to the method of claim 1.

* * * * *